United States Patent [19]

Goodman

[11] 4,117,648

[45] Oct. 3, 1978

[54] AUTOMATIC COLLATOR

[76] Inventor: James A. Goodman, 540 Lincoln Ave., Glencoe, Ill. 60022

[21] Appl. No.: 791,698

[22] Filed: Apr. 28, 1977

[51] Int. Cl.[2] ..... B65B 5/08; B65B 35/38

[52] U.S. Cl. ..... 53/537; 53/247; 214/1 BT; 294/65; 294/87 R

[58] Field of Search ..... 53/164, 165, 247; 214/1 BT; 294/64 R, 65, 87 R

[56] References Cited

U.S. PATENT DOCUMENTS

| | | | |
|---|---|---|---|
| 3,300,945 | 1/1967 | Grossi et al. | 53/247 X |
| 3,374,600 | 3/1968 | Rademacher et al. | 53/247 X |
| 3,453,802 | 7/1969 | Riddington | 53/247 X |

*Primary Examiner*—Robert Louis Spruill

[57] ABSTRACT

This invention relates to a new and useful apparatus for efficiently collating flanged packages at a high speed and then positioning them in a packing carton. The apparatus comprises a collator head assmbly having a plurality of collator heads adjacent one another in a preset configuration. A plurality of air cylinders coupled to the collator heads move the heads in an inward-outward relationship relative to each other enabling collation of the packages attached to the collator heads. Means are provided to enable the collator heads to pick up packages in a preset configuration, transport them to a packaging carton and place them therein.

22 Claims, 21 Drawing Figures

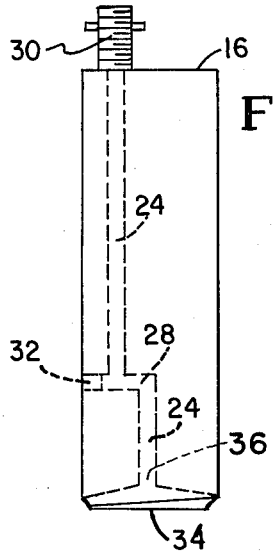
FIG. 16
FIG. 17
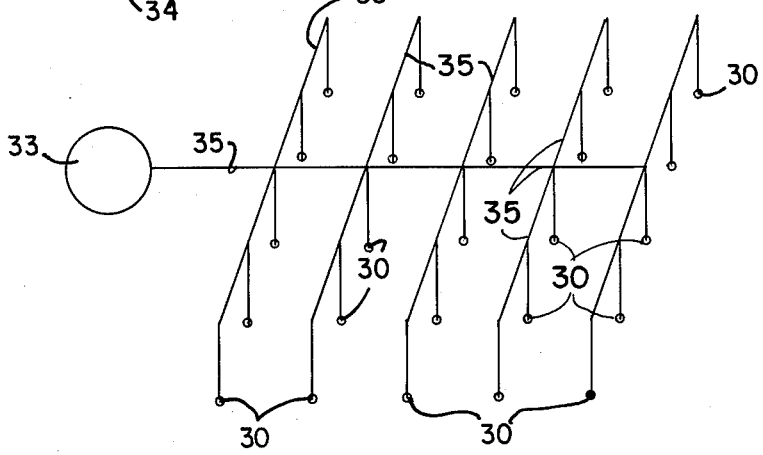
FIG. 18
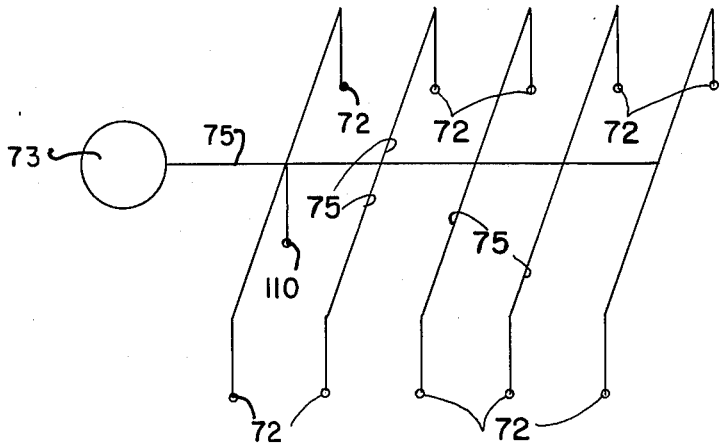

AUTOMATIC COLLATOR

BACKGROUND OF INVENTION

There are many industries that package a product into a small flanged container. The containers are placed into packing cartons by various means. Collation is defined as the overlapping of adjacent flanges of a plurality of flanged containers. There are existing collating devices for flanged containers, however, they are slow and generally inefficient. The most common means for filling a packing carton with containers is by hand which is inefficient, unreliable and expensive. Uncollated flanged containers require a larger packing carton than would be required if the flanged containers were collated. The larger cartons are more expensive and add to the cost of the packaged product. There is a need for a device that can efficiently collate flanged containers at a high speed and position the collated containers into a packing carton. The collated packages require a substantially smaller packing carton than would be required if the containers were uncollated.

A substantial savings in time and thus money can be achieved if collation could be achieved at a speed of several thousand per minute in lieu of the present rate of less than one hundred twenty per minute. This savings of time and hence money reduces the direct cost of packing flanged containers into a packing carton, resulting in a higher profit.

I am not aware of any apparatus or other means that can efficiently pick up a plurality of flanged containers in a preset configuration on a carrier line, collate said containers and then position them in a packing carton at a rate of several thousand per minute. The existing methods for collating flanged containers and positioning them into a packing carton are inefficient, time consuming and expensive.

My collating apparatus will efficiently and effectively take a plurality of flanged containers from a processing or carrier line and position them in a carton so as to enable the minimum size carton to be used for a maximum number of containers at a rate of several thousand per minute. In so doing, a substantial savings will result in labor and material costs.

SUMMARY OF INVENTION

This invention relates to a new and useful apparatus for picking up and collating a plurality of flanged containers from a processing or carrier line and positioning them into a packing carton at a rate of several thousand per minute. My invention is very efficient in that it enables a plurality of flanged containers to be collated into a minimum spacial configuration substantially reducing the size of the carton receiving the containers, thereby substantially reducing the cost of the cartons. In addition, the reduction of time required to fill a carton will result in a substantial savings of money.

In the preferred embodiment there is a collating head assembly having a plurality of collating heads positioned in a specific spacial configuration corresponding to a configuration of flanged containers on a processing or carrier line. The plurality of collating heads when positioned over the containers will, by vacuum means, pick up the containers. The collation of the containers is effectuated by means of a plurality of air cylinders coupled to the collating heads. The plurality of containers in their collated configuration are carried to and positioned within a packing carton by carrier means.

Accordingly, it is an object of this invention to provide a collating apparatus that will efficiently and effectively collate a plurality of flanged containers into a minimum spacial configuration.

Another object of this invention is to provide a collating device that will pick up a plurality of containers from a processing line, collate them into a minimum spacial configuration and then deposit them into a carton at a rate of several thousand per minute.

Another object of the invention is to provide a plurality of collating heads interconnected with each other into a spacial configuration for picking up a plurality of flanged containers.

A further object of the invention is to provide a plurality of collating heads that upon depositing the collated containers into a carton will return to its uncollated configuration.

IN THE DRAWINGS

FIG. 16 is a side elevational view of a modified collator head.

FIG. 17 diagramatically illustrates the air vacuum distributing means embodied by the invention.

FIG. 18 diagramatically illustrates the air supply system embodied by the invention.

DESCRIPTION OF PREFERRED EMBODIMENT

The preferred embodiment illustrated in drawings 1 through 18 and as described herein is not intended to be exhaustive or to limit the invention to the precise form disclosed. It is chosen and described in order to best explain the principles of the invention and its application and practical use to thereby enable others skilled in the art to best utilize the invention.

Figure 1:
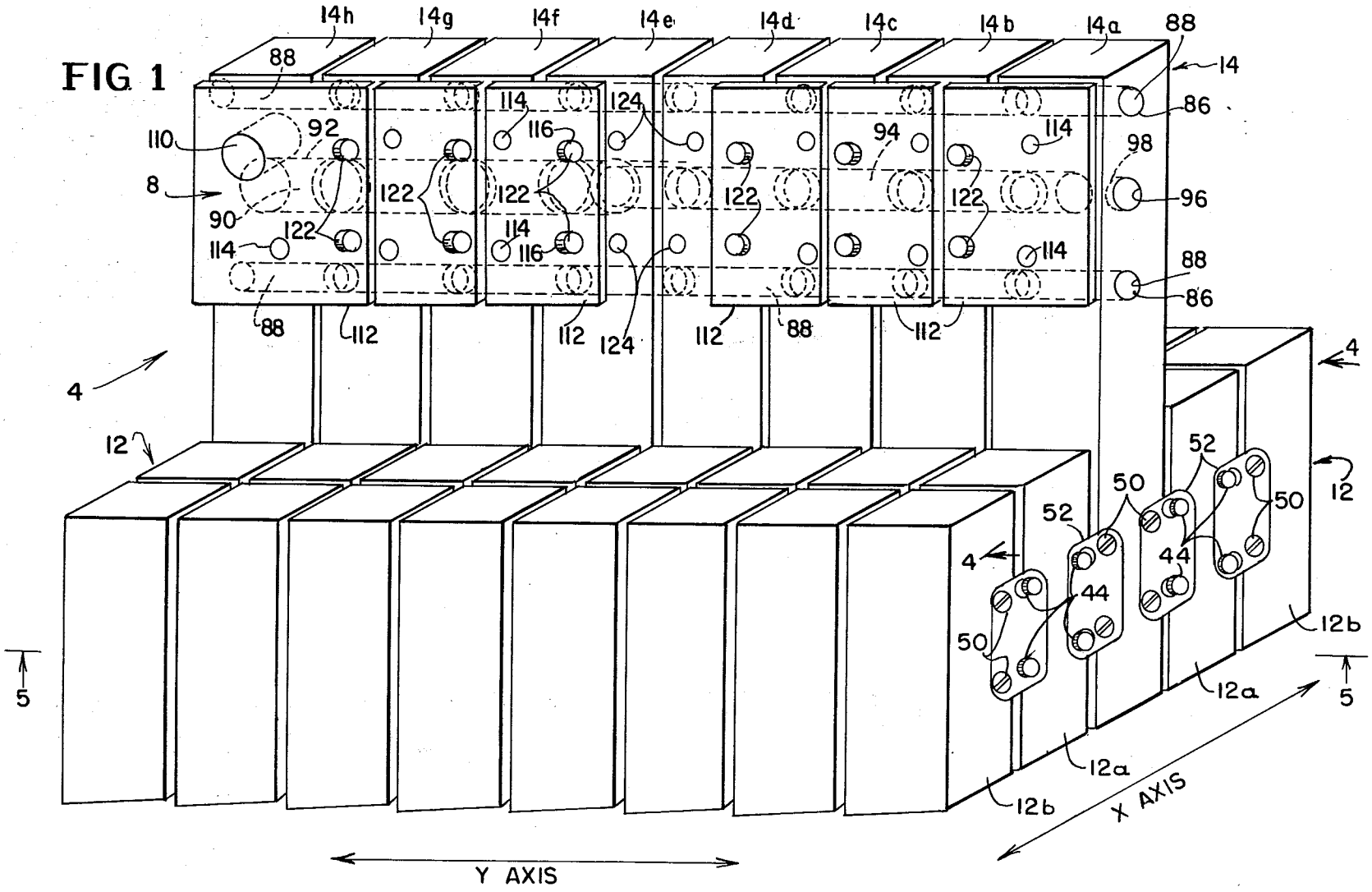
FIG. 1 is a perspective of the collator head assembly in a spacial configuration as embodied in the invention.

The collator embodied by this invention, in its preferred form, is illustrated in the drawings, FIGS. 1 through 18 and is designated generally by the numeral 2. The collator 2 is comprised of a collator head assembly 4, carrier means 6, collating means 8, and air vacuum means 10. The collator head assembly 4 is comprised of a plurality of collator heads 12 and collator head guides 14 positioned adjacent each other in the spacial configuration illustrated in FIG. 1. The spacial configuration illustrated in FIG. 1 is one of an infinite number of configurations that may be used, without departing from the spirit and scope of the invention.

Figures 7, 8, 9, 9A, 10, 13:
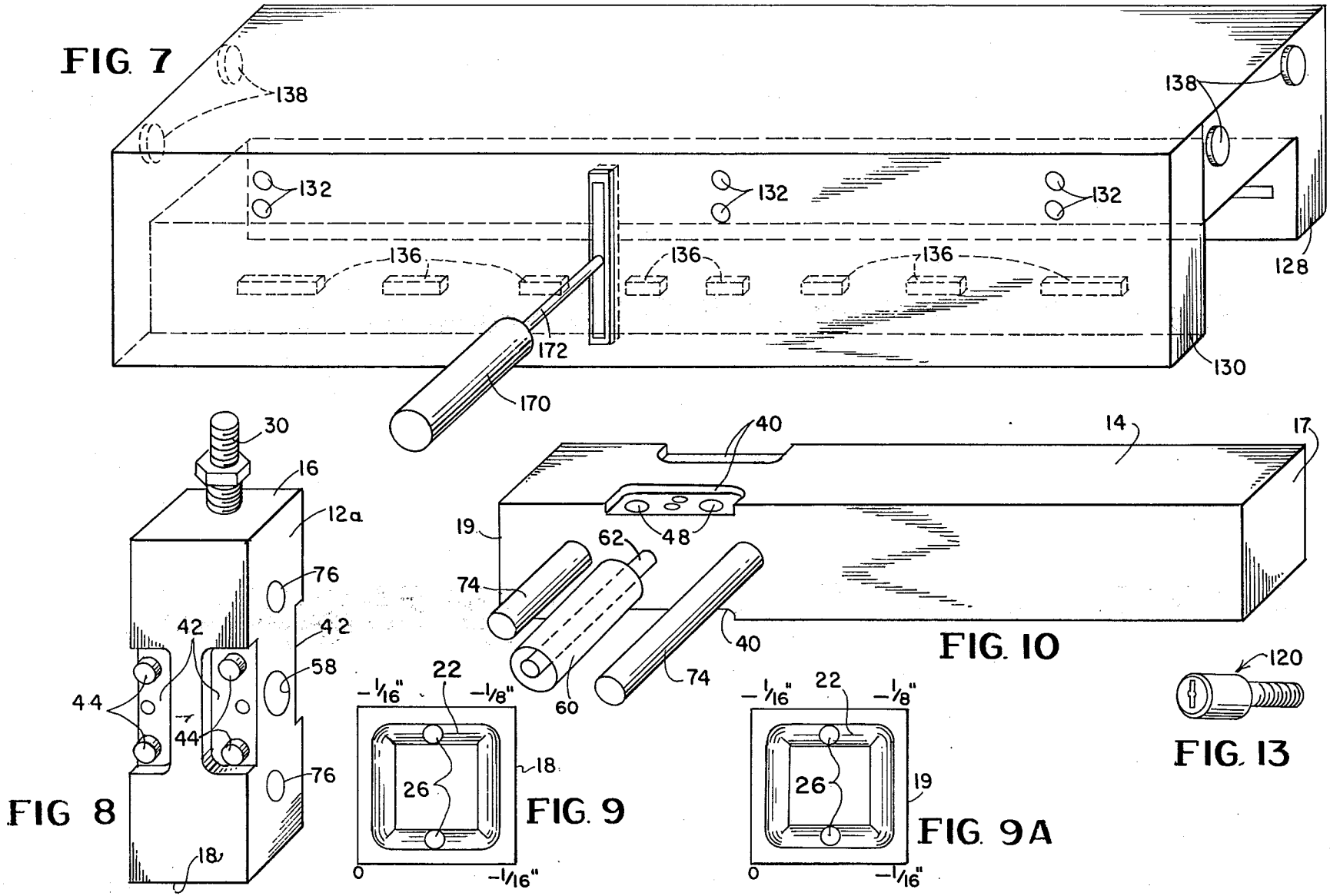
FIG. 7 is a perspective view of the collator head assembly carrier block embodied by the invention.
FIG. 8 is a perspective view of a collator head embodied by the invention.
FIGS. 9 and 9A are bottom views of collator heads embodied by the invention.
FIG. 10 is a perspective of the center collator head embodied by the invention.
FIG. 13 is a perspective view of a cam follower embodied by the invention.

The collator heads 12 and 14 are illustrated in FIGS. 8 and 10 respectively. FIGS. 9 and 9A are illustrative of the bottom view of the collator heads 12 and 14 respectively. The collator heads 12 and 14 are of a substantially rectangular configuration having an upper end 16, 17 and a lower end 18, 19 respectively; said collator heads being cut from steel, aluminum or other similar type stock. It is necessary to have each of the collator heads 12 and 14 substantially rectangular in order to achieve collation of containers 20; said collation being more specifically set forth hereinafter. The substantially rectangular configuration of the collator heads 12 and 14 is achieved by having the height of said heads vary from the top of said collator heads 12, 14 to each corner of the bottom of said collator heads as illustrated in the figures. In FIGS. 9 and 9A each corner of the bottom 18, 19 of the collator heads 12, 14 is designated by the numerals in clockwise order, "0", "−1/16", "−1/8", "−1/16". The maximum height dimension is from the top of said collator head to the "0" corner on the bottom of said collator heads. The minus figures of each of the remaining corners of the bottom of said collator heads represent a figure in inches less than the dimension from the top of the collator heads to the "0" corner on the bottom of the collator heads.

The physical difference between the collator head 12 and the collator head guide 14 is that the height of the head 14 is approximately twice that of the collator head 12. This difference is necessary for reasons that will become obvious further into my description of the preferred embodiment of my invention; the length and width dimensions of said collator heads 12, 14 being the same.

The air vacuum means 10 enables the containers 20 to be coupled to the collator heads 12, 14 of the collator head assembly 4. The air vacuum means are comprised of a vacuum groove 22, air vacuum lines 24, air vacuum apertures 26, connecting air lines 28 and air manifold fitting 30.

Figures 5, 15, 15A:
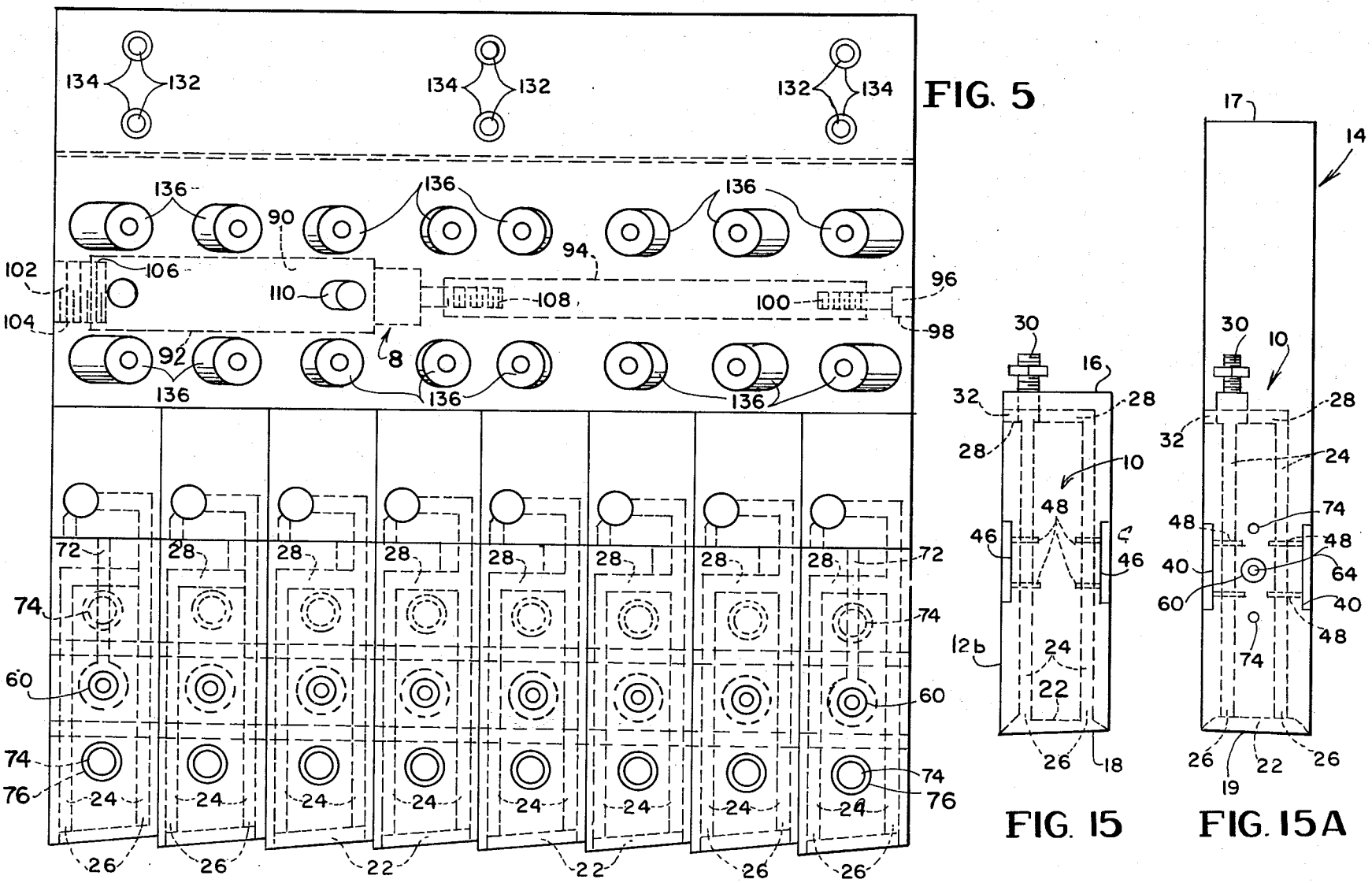
FIG. 5 is a front elevational view of the collator head assembly taken along lines 5—5 of FIG. 1.
FIGS. 15 and 15A are side elevational views of the collator heads embodied by the invention.

The vacuum groove 22 is positioned within the perimeter of the lower ends 18, 19 of each of the collator heads 12 and 14; said groove being cut into the rectangular stock by means well known in the art. A pair of air vacuum lines 24 is machined into the collator heads 12, 14 by means well known in the art, as illustrated in FIGS. 15, 15A. The vacuum lines 24 form a pair of air vacuum apertures 26 at their juncture with the air vacuum groove 22; said apertures being positioned opposite each other. The pair of air vacuum lines 24 are joined together by a connecting air line 28 machined into said collator head 12. An air manifold fitting or connector 30 is coupled to the air vacuum lines 26. A plug 32 is press fit into the line 28, by means well known in the art, creating a direct air passageway from the apertures 26 to the air manifold fitting 30 via the air vacuum lines 24. Vacuum supply means 33, well known in the art, are provided for simultaneously creating a vacuum at the air manifold fittings 30 of each of the plurality of collator heads 12 and 14; thereby creating a vacuum at the air vacuum apertures 26 via the air vacuum lines 24 and the connectng line 28. One of the vacuum supply means 33 for creating a vacuum is a vacuum pump. Flexible tubing 35 is coupled between the vacuum supply means 33 and the air manifold fittings 30 of each of the collator heads 12, 14.

The air vacuum means 10 described hereinabove may be modified as illustrated in FIG. 16. An air suction cup 34 is provided in lieu of the vacuum groove 22. The air suction cup 34 is coupled to the air vacuum line 24 defining an air suction cup aperture 36 at the juncture thereof. Air suction cups are well known in the art and are readily available. If air suction cups 34 are used in lieu of the vacuum groove 22 each of the collator heads 12, 14 would require one air vacuum line 24 in lieu of the two described hereinabove.

Figure 4:
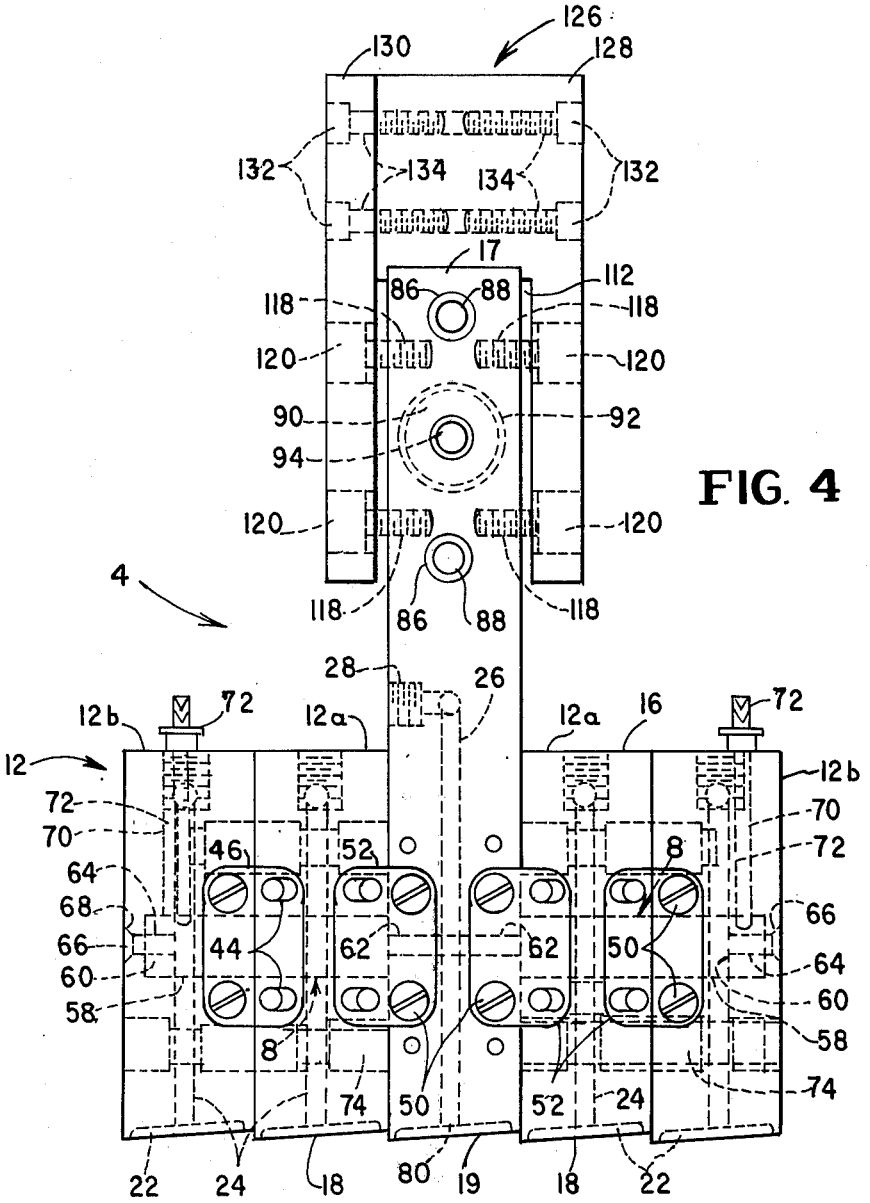
FIG. 4 is a side elevational view of the collator head assembly taken along lines 4—4 of FIG. 1.
Figure 14A:
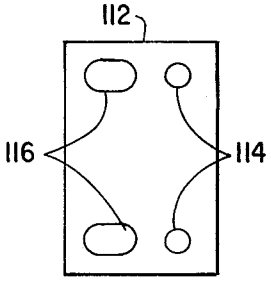
FIGS. 14 and 14A are plan views of the slotted clips embodied by the invention.
Figure 14:
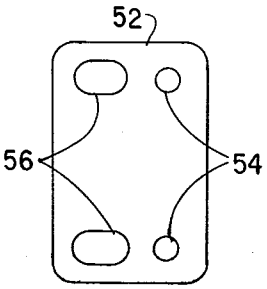
Figure 6:
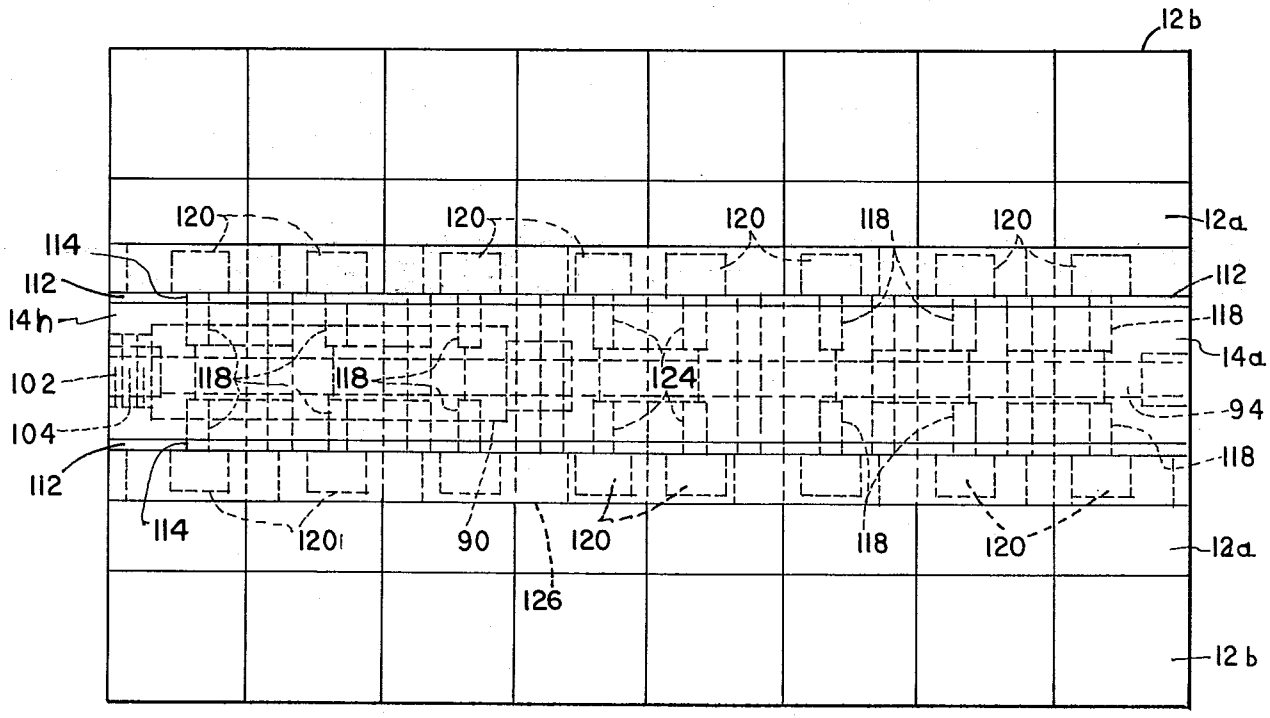
FIG. 6 is a top view of the collator head assembly.

The spacial configuration of the collator head assembly 4 illustrated in the drawings comprises thirty-two collator heads 12 and eight collator guide heads 14. There are a pair of collator heads 12 on each side of a collator guide head 14. The collator heads 12 adjacent the collator head 14 are identified as **12*a* and the outer collator heads 12 are identified as 12*b* to more fully aid in the description of the preferred embodiment. The center or collator guide 14 has a pair of slots 40 machined therein on opposite faces thereof; each pair of slots being positioned opposite each other. The collator heads 12*a*, adjacent each side of the collator guide 14 each have a pair of slots 42 machined therein on opposite faces thereof and each of said slots having placed therein a pair of studs 44. The studs 44 are metal pins pressed into the collator by means well known in the art. The studs 44 extend from the surface of slot 22 to the face of the collator head 12*a*. The collator heads 12*b* illustrated in FIGS. 4 and 15 have a single slot 46 machined therein on opposite faces thereof, said slots positioned to be adjacent the slot 42 of collator head 12*a*. The slot 40 of collator head 14 is also positioned to be adjacent the slot 42 of the collator head 12*a*. A pair of threaded apertures 48 are machined into the slots 46 of the collator head 12*b* and the slots 40 of the center guide collator head 14 for receiving a screw 50; said threaded apertures being positioned opposite the studs 44 in the slot 42 of collator head 12*a*. A slotted clip 52 illustrated in FIG. 14 is positioned within the slots of adjacent collator heads 12*a*, 12*b* and 12*a*, 14; said clip having a pair of apertures 54 and a pair of slots 56. The slots 56 are positioned over the studs 44 of collator head 12*a* and the apertures 54 positioned over the threaded apertures 48 of collator heads 12*b* and 14, as illustrated in FIGS. 1 and 4. The screw 50 is placed into the aperture 54 of the clip 52 and secured to the threaded apertures 48 of collator heads 12*b* and 14. The slot 56 is machined to enable the studs 44** to move approximately one-eighth inch thereby allowing a maximum separation of one-eighth inch between adjacent collator heads.

An air cylinder aperture 58 is positioned in each of the collator heads 12 for receiving an air cylinder 60 and its arm 62. The air cylinder arm 62 is affixed to the collator head 14 by means well known in the art. The air cylinder body 60 has a threaded aperture 64 at its end suitable for receiving a screw 66 affixing the cylinder 60 to the end collator head **12*b* as illustrated in FIG. 4. The collator head 12*b* has an aperture 68 enabling the screw 66 to be fastened to the threaded aperture 64 of the cylinder 60. An air supply line aperture 70 is machined in each collator head 12*b* to enable air to be brought to the air cylinder 60 by means of an air supply line 72. One end of the connector 72 has threaded means for attaching to the cylinder 60; said cylinder having threaded means for receiving said connector. The other end of the connector 72 is suitable for connecting to air supply means 73, one of said means being an air pump. The air supply 73 when actuated causes the air to flow into the air cylinders 60 via air supply distributing means 75 to the connector 72 causing the air cylinder 60 to move against the arm 62. The movement of the cylinder 60 against the cylinder arm 62 results in collator heads 12 moving away, or outward, from the collator head 14 to the extent permitted by the slots 56 of the slotted clip 52. The air cylinder 60 is a type well known in the art having a spring type mechanism, not shown, that enables the cylinder to return to its normal position upon termination of the air supply 73. In my preferred embodiment, the normal position of the heads 12 and 14 is when they abut one another. The heads 12 are extended outward from the head 14 upon activation of the cylinder 60 by the air supply. There is a cylinder 60 and its associated arm 62 for each pair of collator heads 12 adjacent each side of a collator head 14 as illustrated in FIG. 4. In operation all of the cylinders 60 are operated simultaneously by means of a common air supply 73. The air supply distributing means 75** may be flexible tubing or other type of air distributing means well known in the art for simultaneously distributing air to several places or positions.

A pair of guide bars 74 extend from each end of the collator head 14 for stabilizing the outward movement of the collator heads 12. The bars 74 are positioned in guide bar apertures 76 in each of the collator heads 12. The guide bars 74 are affixed to the collator head 14 by means well known in the art.

A pair of guide bar apertures 86 are positioned near the upper end of the collator head 14 for receiving guide bars 88; said guide bars 88 being perpendicular to the guide bars 74. The guide bars 88 stabilize the movement of the collator heads 14; said movement being described hereinafter.

The movement of the collator heads 12 relative to the collator head 14 has been discussed hereinabove, this movement being along an axis that I will define as the "*x*" axis, the axis perpendicular to this being defined as the "*y*" axis. The spacial configuration of the collator head assembly 4 illustrated in FIG. 1 has five heads in the "*x*" axis, consisting of one collator head 14 and four collator heads 12; the configuration along the "*y*" axis being eight groups of the aforesaid five collator heads. To more fully explain and understand the movement of the collator heads in the "*y*" axis I have identified each of the collator heads 14 by the letters "*a*" through "*h*". The movement of collator heads 12 and 14 along the "*y*" axis is achieved by an air cylinder 90 positioned in an air cylinder aperture 92 between the guide bar apertures 86 of the collator guide heads 14. The air cylinder 90 has an air cylinder arm 94 that is attached to one of the end collator heads **14*a* while the cylinder 90 is attached to the collator head 14*h*, opposite thereof, as illustrated in FIGS. 1 and 5**.

The air cylinder arm 94 is attached to the collator head **14*a* by means of a screw 96; said screw passing through an aperture 98 in said collator head 14*a* and a threaded aperture 100 in the cylinder arm. The air cylinder 90 is attached to its collator head 14*h* by means of a screw 102; said screw passing through an aperture 104 in said collator head 14*h* and a threaded aperture 106 in the cylinder. The threaded openings in the cylinder arm and cylinder 100, 106 respectively are suitable for receiving screws 96 and 102** respectively.

The cylinder 90 and its cylinder arm 94 are coupled together by threaded means 104. The cylinder and its arm are of the spring return type well known in the art whereby the arm is retracted in its normal position and is extended when the cylinder is activated by the air supply 73 coupled to air supply connector 110 via air supply distributing means 75. The air cylinder connector 110 has one end threaded for attaching to the air cylinder 90 while its other end is suitable for connecting to the air supply distributing means 75. When the cylinder 90 is activated via the air supply means 73, the arm 94 moves in one direction while the cylinder 90 moves in the opposite direction.

The collating means 8 is comprised of the air cylinders 60, 90 and the structure coupled thereto as described hereinabove.

A pair of slotted clips 112 similar to slotted clip 52 are coupled to each adjacent pair of collator heads 14 on opposite ends thereof as illustrated in FIGS. 1 and 4, said slotted clips having a pair of apertures 114 and a pair of slots 116. Collator heads **14*a, b, c, f, g, h* each have a pair of threaded apertures 118 on opposite sides thereof for receiving a threaded cam follower 120 through the apertures 114 of the slotted clips 112. FIG. 13 illustrates the threaded cam follower 120. Collator heads 14*b, c, d, e, f, g* each have a pair of studs 122 suitable for being received by the pair of slots 116 of the clips 112, said slots enabling said studs to move a maximum distance of one-eighth inch thereby enabling a maximum distance of one-eighth inch between each collator head 14 when the air cylinder 90 and its arm 94 are in its extended position. The studs 122 are press fit into said collator heads by means well known in the art. A pair of threaded apertures 124 is provided, on opposite ends thereof, in collator heads 14*d* and 14*e* for receiving the threaded cam follower 120 without passing through a slotted clip 112**.

A "U" shaped collator head assembly support bracket 126 is formed from an "L" shaped bracket 128 and a plate 130; said "U" shaped bracket being used to support the collator head assembly 4. The plate 130 is fastened to the "L" shaped bracket by means of a plurality of bolts 132 through aperture 134, thereby forming the "U" shaped bracket 126.

A plurality of grooves 136 illustrated in FIG. 7, suitable for receiving the cam followers 120 are channeled into the "L" shaped bracket 128 and the plate 130; the grooves in said bracket and plate being opposite each other when the plate and bracket are fastened together to form the "U" bracket 126. The length of the grooves depends on which collator head 14 and its associated set of cam followers is to be positioned in said grooves. This distance depends upon the desired separation between the collator heads 14 along the "*y*" axis. In my preferred embodiment a one-eighth inch separation is achieved by having the grooves receiving the cams attached to collator head **14*a*, 14*h* be seven-eighths inch long; the grooves receiving the cams attached to collator heads 14*b*, 14*g* be five-eighths inch long; the grooves receiving collator heads 14*c*, 14*f* be three-eighths inch long and the grooves receiving collator heads 14*e*, 14*d* be one-eighth inch long. In so doing, the collator heads 14*a* through *h* will be separated by one-eighth inch when the cylinder 90 is activated moving the cylinder 90 in one direction and its cylinder arm 94 in the opposite direction. The slotted plates 112, as described above, also restrict the distance between the collator heads 14 to one-eighth inch when the cylinder 90 is activated. When the cylinder 90 is not activated the collator heads 14***a* through *h* abut one another as does the collator heads 12 coupled to each of the heads 14. The collator head assembly 4 is coupled to the support bracket 126 by means of the cam followers 120 positioned within grooves 136.

Figure 2:
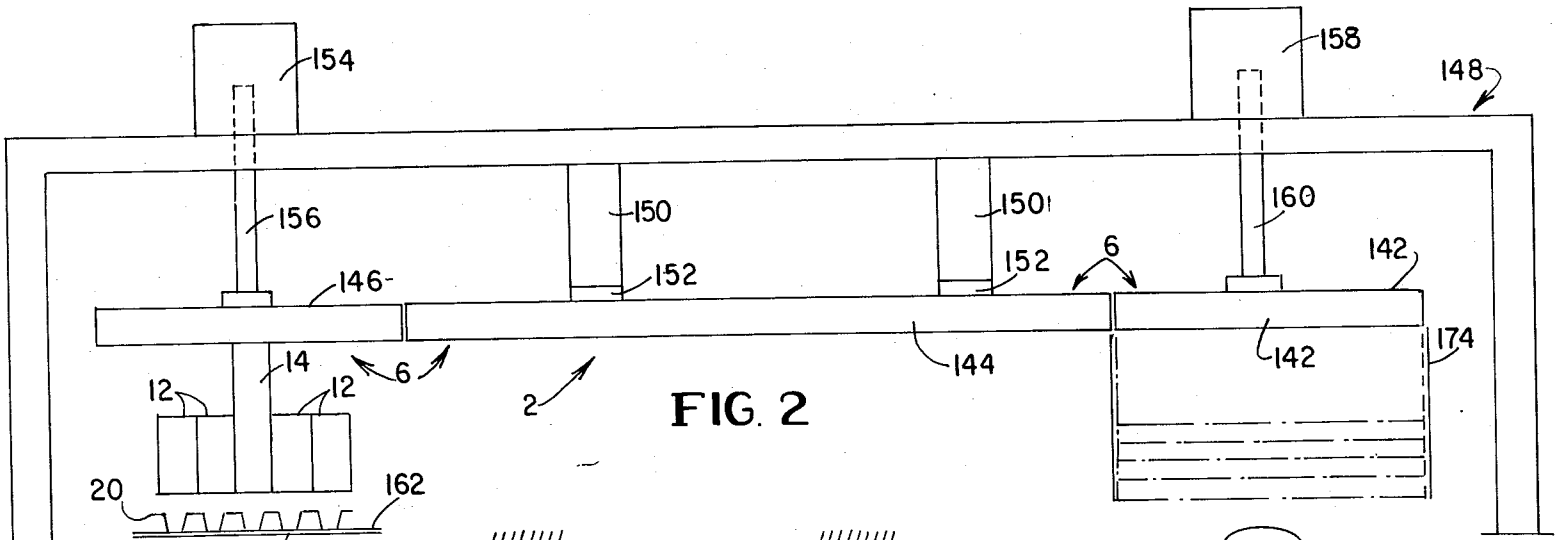
FIG. 2 is a front elevational schematic view of the collator as embodied by the invention.
Figure 3:
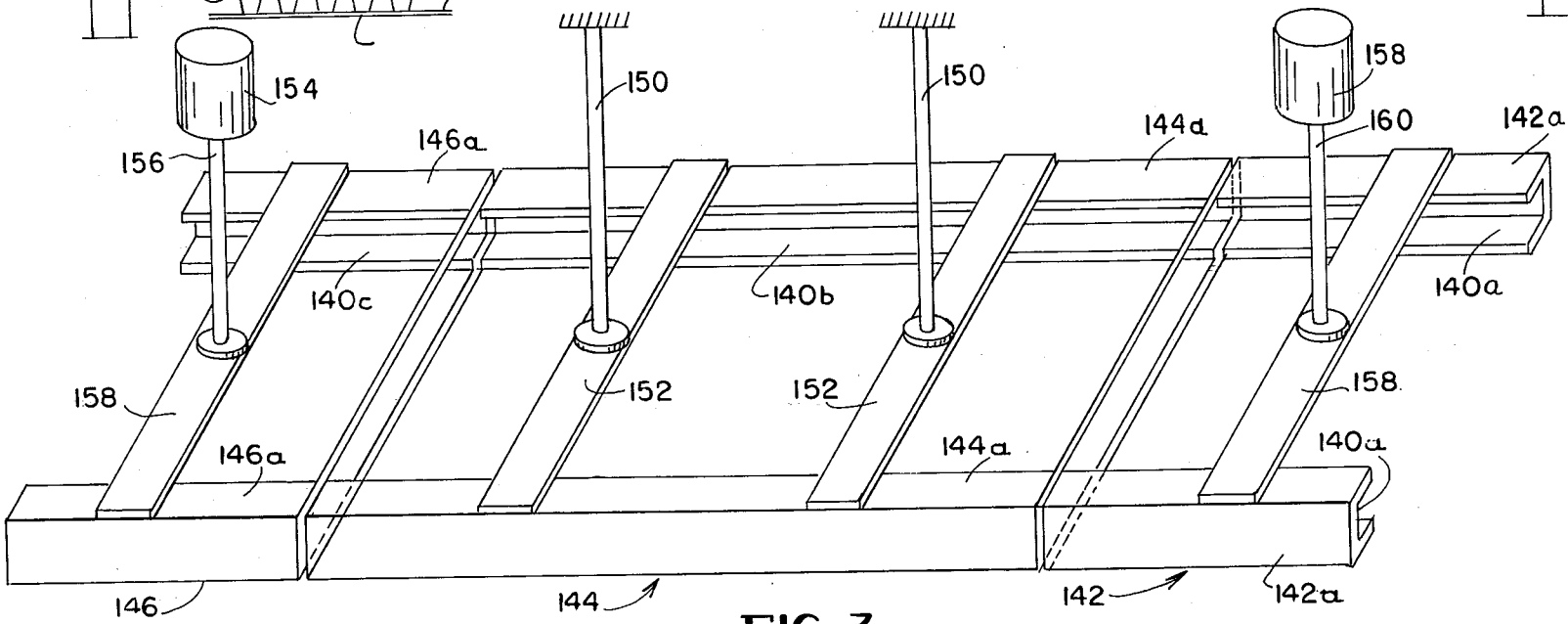
FIG. 3 is a perspective schematic view of the collator guide track system as embodied by the invention.

The "U" shaped bracket 126 has a pair of cams 138 on each end thereof as illustrated in FIG. 7. The cams 138 are suitable for being positioned into the carrier means 6. The carrier means 6 comprises three channel sections 142, 144, 146 coupled to a collator support structure 148 in a linear configuration. The three channel sections 142, 144, 146 each comprise a pair of channel members 142*a*, 144*a*, 146*a* respectively. Each of the pair of channel members 142*a*, 144*a*, 146*a* is of a "U"-shaped configuration defining a channel 140*a*, 140*b*, 140*c* respectively between the sides of the "U"; said channels being suitable for, and positioned relative to each other for, receiving the cams 138 of the "U" shaped support bracket 126. The carrier means 6 enables the collator head assembly 4 to traverse the support structure 148 from one end thereof to the other. The cams 138 support the "U" shaped support bracket 126 within the channels 140*a*, 140*b*, 140*c* and facilitate the movement of said bracket within said channels. The collator support structure 148 is fixed either directly to the floor, as illustrated in FIG. 2 or to another apparatus, such as a conveyor system, not shown, for transporting the containers 20. There are many means well known in the art for securing the structure 148 any of which can be used without departing from the spirit and scope of the invention. Channel section 144 is secured to the structure 148 by means of support arms 150, said arms being attached to said channel section by means of tie bars 152. Channel sections 142, 146 have means for enabling said sections to be lowered to a predetermined height and raised again. One of the means illustrated is an air cylinder 154, 158 having arms 156, 160 respectively coupled to the channel sections 142 and 146 by means of a tie bar 158. There are other means well known in the art for lowering and raising sections 142, 146 any of which can be used without departing from the spirit and scope of the invention.

Figure 12:
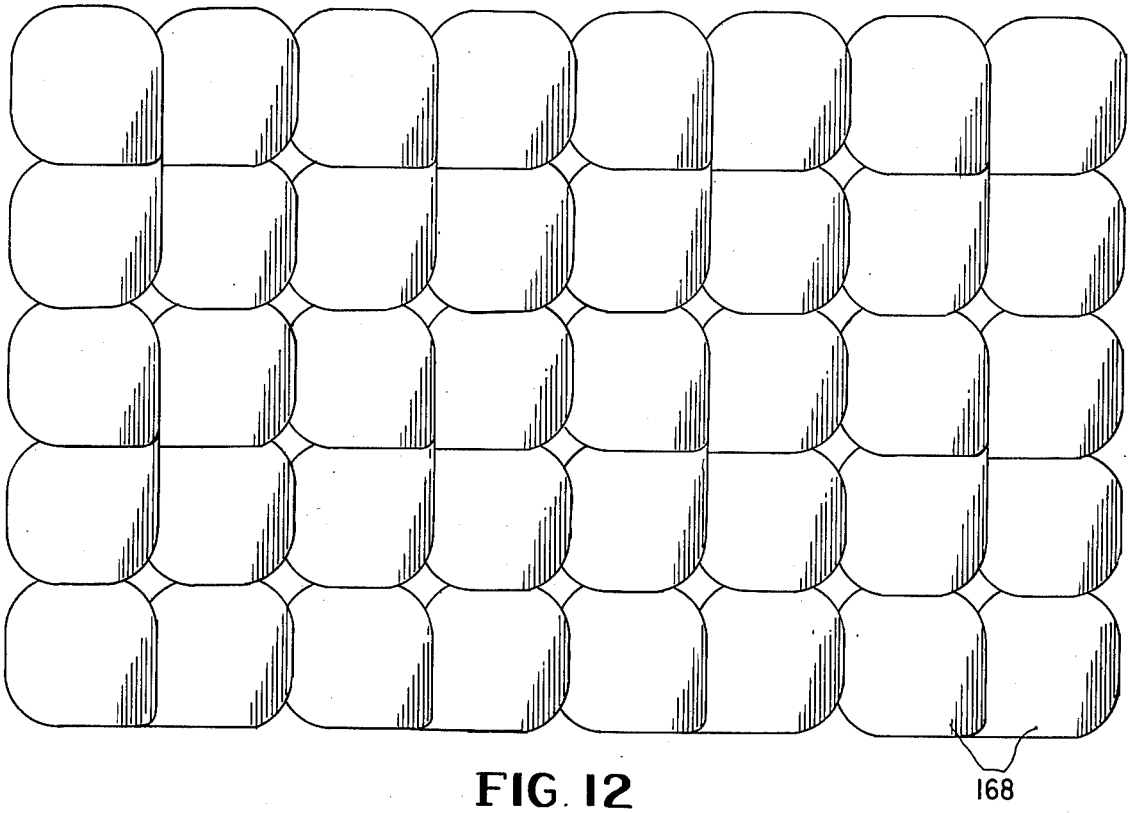
FIG. 12 is a top view of the collated containers.
Figure 11:
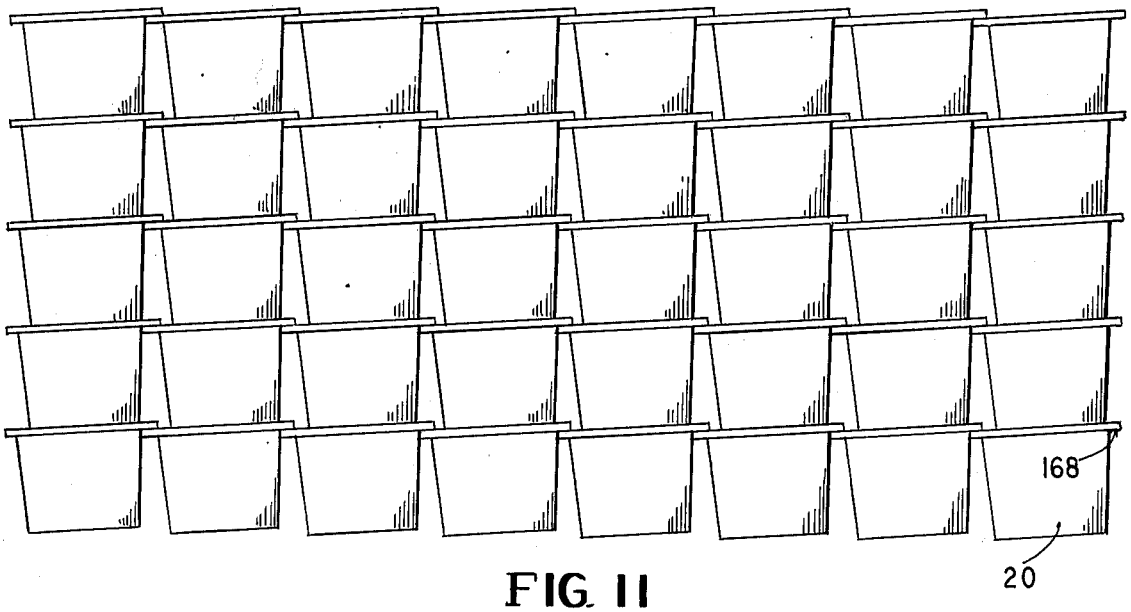
FIG. 11 is a front elevational view of the collated containers.

A conveyor means 162 transports the containers 20 to a position enabling said containers to be picked up by the collator heads 12, 14. The conveyor means may be a conveyor belt, flite carrier, or other conveying means well known in the art. The configuration of containers on the conveyor means 162 must be the same as the configuration of collator heads 12, 14. When the containers 20 are directly under the collator heads 12, 14, the air cylinder 154 is activated enabling channel section 146 to move in a downward direction positioning the collator heads 12, 14 over the containers 20. Air vacuum means 33 are activated when the collator heads are adjacent the containers 20. The vacuum created by the vacuum means 33 is transmitted simultaneously to the air vacuum apertures 26 or suction cup 34 of the collator heads 12, 14 via the air vacuum supply means 35. The vacuum enables the containers to become coupled to the collator heads 12, 14. The containers 20 once attached to the collator heads 12, 14 are raised by means of the air cylinder 154 via the support section 146. The collation of the containers held by the collator heads 12, 14 is effectuated when the air supply 33 to air cylinders 60 and 90 is terminated; the aforesaid cylinders 60, 90 being of the spring release type enables all of the collator heads 12, 14 to abut with their adjacent collator heads. The angle of the lower end of said collator heads as described hereinabove and illustrated in the drawings enables the flanges 168 of the containers to overlap one another as is illustrated in FIGS. 11 and 12.

When the section 146 is raised to the same level as channel sections 142 and 144 an air cylinder 170 is activated, said cylinder 170 having an arm 172 coupled to the "U" shaped support bracket 126 for moving said "U" shaped bracket and the collator head assembly 4 coupled thereto to channel section 142 via channel section 144. When the "U" shaped bracket 126 is positioned on channel section 142, air cylinder 158 is activated causing its arm 160 to move in a downward direction for a pre-determined distance placing the configuration of containers 20 into a packing carton 174. The packing carton 174 is positioned on a table or conveyor, not illustrated, so as to enable the spacial configuration of collator heads 12, 14 to move downward within said carton. When the containers 20 are released, by cutting off the vacuum means 33, the collator heads 12, 14 are moved upward by means of the air cylinder arm 160 of air cylinder 158 to a position where channel structure 142 is level with channel structure 144. When channel 142 is level with channel structure 144, air cylinder 170 is activated by means well known in the art causing the "U" shaped structure 126 and the collator head assembly 4 coupled thereto to be conveyed, by means of arm 172, back to channel section 146 across channel section 144. When the "U" shaped bracket 126 is positioned on channel structure 146, cylinder 154 is activated again causing channel section 146 to be lowered enabling a new set of containers 20 to be attached to the collator heads 12, 14. The above process is repeated until the carton 174 is full. The cylinder 158 is electrically programmed by means well known in the art to descend into the packing carton in steps, each step representing the height of the containers, enabling an even distribution of containers within the carton. When the carton 174 is filled, the cylinder program is reset enabling the channel section 142 to descend fully to the bottom of said carton; each subsequent time the downward movement being stopped for stacking the containers 20 within the carton.

The air cylinder arm 172 is positioned in a slot 176 in "U" shaped bracket 126 thereby enabling the channel sections 142 and 146 to move in an upward-downward direction without being disengaged from said "U" shaped bracket, the arm 172 moving the "U" shaped bracket 126 and the collator head assembly 4 coupled thereto from channel section 146 to channel section 142 via channel section 144 and back to channel section 142.

Electrical control means well known in the art and not illustrated are used to activate and deactivate the air cylinders 60, 90, 154, 158, and 170 as well as the air vacuum means 33 and air supply means 73. When air is supplied to cylinders 60 and 90 via air supply means 73 a one-eighth inch space between each pair of collator heads 12 and 14 is created. It is this separated configuration of collator heads 12 and 14 illustrated in FIG. 1, that descends via section 146 to the containers 20 on the conveyor means 162. The air vacuum means 33 are activated when the collator heads 12, 14 are adjacent the containers 20 creating a vacuum simultaneously at the air vacuum apertures 26 or suction cups 34 of said collator heads 12, 14. The vacuum created at the air vacuum apertures 26, or suction cup 34 enables the containers 20 to be coupled to said collator heads at which time the channel section 146 rises to the level of channel section 144. At this time the air supply 73 to cylinders 60 and 90 is terminated causing each of the collator heads 12, 14 to abut their adjacent collator head thereby causing the collation of the containers 20 by having the adjacent flanges of said containers overlap one another, as illustrated in FIGS. 11 and 12.

Air cylinder 170 is activated upon section 146 returning to its initial level adjacent channel section 144 enabling the cylinder arm 172 to impart motion to the "U" shaped bracket 126 from section 146 to section 142 via section 144. When the "U" shaped bracket 126 carrying the collated containers 20 via collator heads 12, 14 reaches a preset point on section 142, cylinder 158 is activated lowering the section 142 thereby enabling the containers 20 to be positioned within the carton 174 at which time the vacuum means 33 holding the containers to the heads 12, 14 is terminated releasing said containers into the carton. The section 142 rises, after depositing the containers 20 into the carton 174, to the level of section 144 at which time cylinder 170 is activated causing cylinder arm 172 to return the "U" shaped bracket and its attached collator heads to channel section 146 via channel section 144; the aforesaid cycle then repeating.

The air cylinders 154, 158 and 170 each have an air supply means, not illustrated, but well known in the art, coupled thereto enabling their respective cylinder arms 156, 160 and 172 to move from one position to another. The electrical control means, not illustrated, will initiate a signal at the proper time to activate or deactivate the air supply means.

It is understood that a separation between adjacent collators other than the one-eighth inch described hereinabove may be used without departing from the spirit and scope of the invention.

It is believed that the invention has been described in such detail as to enable those skilled in the art to understand the same and it will be appreciated that variations may be made without departing from the spirit and scope of the invention.

What is described to secure by letters patent in the United States is:

1. A high speed automatic collating apparatus for collating a plurality of flanged containers and positioning the collated containers into a packing carton; said apparatus comprising:

a support structure;

carrier means coupled to said support structure;

a support bracket having means for being coupled to the carrier means;

a collator head assembly coupled to the support bracket;

air vacuum means coupled to the collator head assembly enabling said plurality of flanged containers to be coupled thereto in a predetermined configuration; and collating means coupled to the collator head assembly for overlapping the flanges of adjacent containers to form a collated group at a time after said containers are coupled to the collator head assembly.

2. A high speed automatic collating apparatus as defined in claim 1, wherein said carrier means comprises a plurality of channel sections in a linear configuration, said channel sections having a "U" shaped configuration defining a channel between the sides of the "U".

3. A high speed automatic collating apparatus as defined in claim 2, wherein said apparatus further comprises means coupled to the support structure and two of the plurality of channel sections enabling the support bracket and collator head assembly coupled thereto to be lowered from a preset elevation and returned thereto.

4. A high speed automatic collating apparatus for collating a plurality of flanged containers as defined in claim 3 wherein said apparatus further comprises means for conveying the support bracket along the plurality of linearly positioned channel sections.

5. A high speed automatic collating apparatus as defined in claim 4 wherein said apparatus further comprises means for conveying a plurality of flanged containers in a preset configuration to a position enabling the coupling of said containers to the collator head assembly.

6. A high speed automatic collating apparatus as defined in claim 5 wherein the collator head assembly comprises:

a plurality of collator heads;

a plurality of collator guide heads; and means for coupling said collator heads and collator guide heads in a preset spacial configuration.

7. A high speed automatic collating apparatus as defined in claim 6 wherein the air vacuum means coupled to the collator head assembly comprises:

a vacuum groove machined into the bottom portion of each of the collator heads and collator guide heads;

an air vacuum line machined into each of said collator heads and collator guide heads and positioned so as to juncture with the vacuum groove;

air vacuum apertures defined by the juncture of the vacuum groove and the air vacuum line;

an air manifold fitting coupled to the top end of each of the collator heads and collator guide heads; said manifold fitting being connected to the air vacuum line; and an air vacuum means coupled to the air manifold fittings.

8. A high speed automatic collating appartus as defined in claim 6 wherein the air vacuum means coupled to the collator head assembly comprises:

a suction cup positioned at the bottom end of each of the plurality of collator heads and collator guide heads;

an air vacuum line machined into each of said collator heads and collator guide heads and positioned so as to be connected to the suction cup;

an air manifold fitting coupled to the top end of each of the collator heads and collator guide heads, said manifold fitting being connected to the air vacuum line; and an air vacuum means coupled to the air manifold fittings.

9. A high speed automatic collating apparatus as defined in claim 8 wherein said collating means comprises:

a plurality of air cylinders positioned within and coupled to the plurality of collator heads, there being one cylinder for each pair of the plurality of collator heads;

an air cylinder arm coupled to each of the plurality of air cylinders, each of the plurality of air cylinder arms having one end thereof coupled to each air cylinder and its other end connected to a collator head guide; and air supply means coupled to each of the plurality of air cylinders wherein the air supply means enables the air cylinder to move in a direction opposite its arm, the arm being connected and fixed to a collator guide head; the movement of the cylinder moving the pair of collator heads away from the collator guide head in a direction defined as the "*x*" direction.

10. A high speed automatic collating apparatus as defined in claim 9 wherein said collating means further comprises:

a collator head guide air cylinder having an air cylinder arm positioned in the plurality of collator head guides, said collator head guides being in a linear configuration, one end of the cylinder being connected to one end of the linear configuration of the plurality of collator guide heads and the air cylinder arm being connected to the opposite end of the linear configuration of the plurality of collator head guides; and air supply means coupled to the collator head guide air cylinder enabling the air cylinder and the air cylinder arm to move in opposite directions moving the plurality of collator head guides away from each other in a direction perpendicular to the movement of the collator heads, said direction being defined as the "*y*" direction.

11. A high speed automatic collating apparatus as defined in claim 10 wherein the means for coupling the collator heads and collator guide heads in a preset spacial configuration comprises:

a slotted clip coupled to each adjacent pair of collator heads, said slotted clips having a pair of slots and a pair of apertures positioned opposite said slots; and means coupled to the collator heads for engaging said slots, wherein said slots are machined to enable movement of the means coupled to the collator heads for engaging said slots and the collator heads to which said means are coupled a predetermined distance.

12. A high speed automatic collating apparatus as defined in claim 11 wherein the means for coupling the collator heads and collator guide heads in a preset spacial configuration further comprises:

a slotted clip coupled to each adjacent pair of collator head guides, said slotted clips having a pair of slots and a pair of apertures positioned opposite said slots;

means coupled to the collator head guides through the slotted clip apertures attaching said clip to the collator head guide; and slot engaging means coupled to the collator head guides for engaging the slots of the slotted clip, wherein the said slots are machined to enable movement of the slot engaging means and the collator head guides to which said means are coupled a predetermined distance.

13. A high speed automatic collating apparatus as defined in claim 12 wherein the means coupled to the collator head guides through the slotted clip apertures is a cam follower.

14. A high speed automatic collating apparatus as defined in claim 13, said support bracket comprises:

an "L" shaped bracket;

a plate; and connecting means for connecting the "L" shaped bracket and plate together in a "U" shaped configuration.

15. A high speed automatic collating apparatus as defined in claim 14 wherein said support bracket further comprises:

a plurality of grooves machined into the "L" shaped bracket and plate, each groove being of a preset length and so positioned that the grooves in the bracket and plate of the same length are positioned opposite one another when connected into the "U" shaped bracket; said grooves being suitable for receiving the cam followers.

16. A high speed automatic collating apparatus as defined in claim 15 wherein the connecting means for connecting the "L" shaped bracket and plate together is a plurality of threaded bolts.

17. A high speed automatic collating apparatus as defined in claim 16 wherein said support bracket further comprises a pair of cams on each side of the support bracket, said cams being positioned for engaging the channels of the plurality of linearly positioned channel sections.

18. A high speed automatic collating apparatus as defined in claim 17 wherein the means for conveying the support bracket along the plurality of linearly positioned channel sections is an air cylinder having an air cylinder arm coupled to one end and the other end being coupled to the support bracket, said air cylinder having means for receiving an air supply, wherein when air is supplied to the cylinder, the cylinder arm is extended moving the support bracket cams along the channels of the linearly positioned channel sections.

19. A high speed automatic collating apparatus as defined in claim 18 wherein the means for conveying a plurality of flanged containers to the collator head assembly is a conveyor belt system.

20. A high speed automatic collating apparatus as defined in claim 19 wherein the means coupled to the collator heads for engaging the slots of the slotted clip are studs press fit into said collator heads.

21. A high speed automatic collating apparatus as defined in claim 20 wherein the slot engaging means coupled to the collator head guides are studs press fit into said collator head guides

22. A high speed automatic collating apparatus as defined in claim 21 wherein the means coupled to the support structure and two of the plurality of channel sections for lowering said sections from a preset elevation and returned thereto are air cylinders having coupled thereto air cylinder arms.

* * * * *